US009808731B1

(12) United States Patent
Liu

(10) Patent No.: US 9,808,731 B1
(45) Date of Patent: Nov. 7, 2017

(54) TRANSFORMATION MECHANISM ASSEMBLY, DRIVING MODULE ASSEMBLY, TRANSFORMABLE TOY CAR, AND ROBOT

(71) Applicant: Kinpo Electronics, Inc., New Taipei (TW)

(72) Inventor: Kuan-Che Liu, New Taipei (TW)

(73) Assignee: Kinpo Electronics, Inc., New Taipei (TW)

( * ) Notice: Subject to any disclaimer, the term of this patent is extended or adjusted under 35 U.S.C. 154(b) by 0 days.

(21) Appl. No.: 15/434,068

(22) Filed: Feb. 16, 2017

(30) Foreign Application Priority Data

Jan. 5, 2017 (TW) ..... 106100324 A

(51) Int. Cl.
*A63H 33/00* (2006.01)
*A63H 17/26* (2006.01)
*A63H 17/02* (2006.01)

(52) U.S. Cl.
CPC ..... *A63H 33/003* (2013.01); *A63H 17/26* (2013.01)

(58) Field of Classification Search
CPC ..... A63H 3/00; A63H 3/003; A63H 33/00; A63H 33/003; A63H 11/00; A63H 11/10; A63H 17/00; A63H 17/02; A63H 17/26
USPC ..... 446/230, 321, 376, 378, 390, 431, 437, 446/465, 468, 469, 470, 471
See application file for complete search history.

(56) References Cited

U.S. PATENT DOCUMENTS 4,578,046 A * 3/1986 Ohno ..... A63H 33/003 446/376
4,580,993 A * 4/1986 Ohno ..... A63H 33/003 446/376
5,052,680 A * 10/1991 Malewicki ..... A63H 33/003 100/233
5,810,638 A * 9/1998 Wood ..... A63H 11/10 446/230
7,927,174 B2 * 4/2011 Kim ..... A63H 33/003 446/321
2008/0233833 A1 * 9/2008 Toriyama ..... A63H 3/003 446/321
2011/0111672 A1 * 5/2011 Miyake ..... A63H 17/02 446/378

FOREIGN PATENT DOCUMENTS

CN 205019716 2/2016

* cited by examiner

*Primary Examiner* — Kien Nguyen
(74) *Attorney, Agent, or Firm* — JCIPRNET

(57) ABSTRACT

A transformation mechanism assembly is adapted to a transformable toy car that includes a head, a main body, a right front door, a left front door, a rear left door, a rear right door and a right tail and a left tail, separable from each other. The two sides of the main body are respectively provided with the transformation mechanism assembly corresponding to the left front door, left rear door, right front door and right rear door, and the main body is adapted to pivotally rotate in relative to the head. The transformation mechanism includes a first driving unit, a driving rod, a linkage mechanism and a support rod. In addition, a transformable toy car, a driving module assembly adapted to drive the transformable toy car and the transformation mechanism assembly, and a robot are also mentioned.

12 Claims, 5 Drawing Sheets

TRANSFORMATION MECHANISM ASSEMBLY, DRIVING MODULE ASSEMBLY, TRANSFORMABLE TOY CAR, AND ROBOT

CROSS-REFERENCE TO RELATED APPLICATION

This application claims the priority benefit of Taiwan application serial no. 106100324, filed on Jan. 5, 2017. The entirety of the above-mentioned patent application is hereby incorporated by reference herein and made a part of this specification.

BACKGROUND OF THE INVENTION

1. Field of the Invention

The present invention generally relates to a transformation mechanism assembly and a driving module assembly, in particular, to a transformation mechanism assembly and a driving module assembly that are adapted to transform a transformable toy car into a robot.

2. Description of Related Art

In current design of a transformable toy car, when the transformable toy car is transformed into a robot, a tail is generally used as a foot pedestal of the robot that is obtained after the transformation. That is, during the transformation of the transformable toy car, a head and a main body are turned over relative to the tail. In other words, after an ordinary transformable toy car is transformed, a head becomes a head or the top of a robot, and a tail of the transformable toy car becomes a foot pedestal of the robot. Besides, when a main body of the transformable toy car pivotally rotates relative to the tail, the main body of the transformable toy car is purely driven by a motor and a gear without using, in combination, any other linkage mechanisms to drive different parts of the transformable toy car to move. Therefore, currently, when an ordinary transformable toy car is transformed into a robot, except for an emphasis on lifting a main body and a tail of the car, a structure of the transformable toy car is not significantly changed. Therefore, a car transformation manner and a transformation extent of the transformable toy car are restricted, and a transformation form is also relatively rigid. Further, in design of an ordinary transformable toy car, rear wheels are used as driving wheels to control forward movement or backward movement of the transformable toy car, and adjustment of a moving direction of the car also depends on a speed difference of the two rear wheels, thereby limiting a deflection direction and a deflection amplitude of the moving transformable toy car.

SUMMARY OF THE INVENTION

The present invention provides a transformation mechanism assembly, adapted to drive a transformable toy car to be transformed into a robot.

The present invention provides a driving module assembly, adapted to drive a transformable toy car and a transformation mechanism assembly to move.

The present invention provides a transformable toy car, which includes front wheels at two sides and a driving roller that are arranged as an inverted triangle. The front wheels at the two sides and the driving roller together provide balanced and stable support before and after the transformable toy car is transformed into a robot.

The present invention provides a robot, which can be obtained by transforming a transformable toy car, and can stand at a plane by means of support of front wheels at two sides of a head and a driving roller of a main body.

The transformation mechanism assembly of the present invention is adapted to a transformable toy car. The transformable toy car includes a head, a main body, a left front door, a right front door, a rear left door, a rear right door, and a left tail and a right tail separable from each other. Two sides of the main body are respectively provided with the transformation mechanism assembly corresponding to the left front door, the rear left door, the right front door, and the rear right door, and the main body is adapted to pivotally rotate in relative to the head. The transformation mechanism assembly includes a first driving unit, a driving rod, a linkage mechanism, and a support rod. The first driving unit is pivotally connected to the main body, and the first driving unit includes a driving roller. The driving rod includes a first end and a second end opposite to each other, and the driving rod is pivotally connected to the first driving unit via the first end. The linkage mechanism is pivotally connected to the main body, and the linkage mechanism includes a first linkage, a second linkage, and a third linkage. The first linkage includes a first pivoting end, a second pivoting end, and a first connecting end. The first pivoting end is pivotally connected to the main body, and the second pivoting end is pivotally connected to the second end of the driving rod. The left front door and the right front door are respectively connected to the first linkage via the first connecting end. The second linkage includes a third pivoting end and a fourth pivoting end, and the second linkage is pivotally connected to the main body via the third pivoting end. The third linkage is pivotally connected to the second linkage, and the left front door and the right front door are respectively pivotally connected to the second linkage via the third linkage. The support rod is pivotally connected to the fourth pivoting end of the second linkage, and the left tail and the right tail are respectively pivotally connected to the support rod. The first driving unit is adapted to push the driving rod towards directions of the left tail and the right tail, and the driving rod drives the first linkage to pivotally rotate in relative to the main body. The left front door and the right front door are respectively pushed by the first linkage to move towards directions away from the main body. The left front door and the right front door respectively pivotally rotate in relative to the main body by means of the second linkage and the third linkage. The support rod, the left tail, and the right tail are respectively pushed by the second linkage to move towards directions away from the main body.

The driving module assembly of the present invention includes the first driving unit and is adapted to drive the transformation mechanism assembly and the transformable toy car. The transformable toy car further includes front wheels at two sides. The driving module assembly includes a second driving unit and a steering module. The second driving unit is coupled to the main body, and may be adapted to drive the main body to pivotally rotate in relative to the head. The steering module is disposed between the front wheels at the two sides. The steering module includes a steering driving unit, a steering linkage, and two steering shafts. The steering linkage is coupled to the steering driving unit. The two steering shafts are respectively disposed at two ends of the steering linkage. The front wheels at the two sides are respectively pivotally connected to the steering linkage via the two steering shafts.

The transformable toy car of the present invention is adapted to be transformed, after being driven, into a robot. The transformable toy car includes a head, a main body, a pair of front wheels, a steering module, and a driving roller. The main body is pivotally connected to the head, and the front wheels are respectively pivotally connected to two sides of the head. The steering module is disposed between the front wheels. The driving roller is disposed at the main body, and the pair of front wheels and the driving roller are arranged as an inverted triangle. When the transformable toy car is transformed into a robot, the front wheels and the driving roller together support the robot.

A robot of the present invention is adapted to be obtained by transforming a transformable toy car. The transformable toy car includes a head, a main body, a pair of front wheels, and a driving roller. The main body is pivotally connected to the head, and the front wheels are respectively pivotally connected to two sides of the head. The driving roller is pivotally connected to the main body, and the front wheels and the driving roller are arranged as an inverted triangle. The robot includes a foot pedestal portion and a body portion. The head is transformed into the foot pedestal portion, and the body portion is pivotally connected to the foot pedestal portion. The main body of the transformable toy car pivotally rotates in relative to the head, and therefore is lifted and transformed into the body portion. The front wheels and the driving roller together support the robot to stand at a plane.

In an embodiment of the present invention, the aforementioned second linkage has a second connecting end, and the rear left door and the rear right door are respectively connected to the second connecting end.

In an embodiment of the present invention, the aforementioned transformable toy car includes a circuit board, and the circuit board is disposed in the main body.

In an embodiment of the present invention, the aforementioned second driving unit is a driving gearbox, and the second driving unit is coupled between the first driving unit and the main body.

In an embodiment of the present invention, the aforementioned first driving unit further includes a switching actuator for switching between driving outputs of the first driving unit to the driving roller and the driving gearbox.

In an embodiment of the present invention, the aforementioned second driving unit is a drive motor.

In an embodiment of the present invention, the aforementioned first driving unit further includes a power source for providing a driving force for the first driving unit.

In an embodiment of the present invention, the aforementioned steering driving unit is a steering drive motor or a steering actuator.

Based on the above, in a plurality of embodiments of the present invention, a transformation mechanism assembly is adapted to enable a main body of a transformable toy car to pivotally rotate in relative to a head, thereby transforming the transformable toy car into a robot. The transformation mechanism assembly includes a first driving unit, a driving rod, a linkage mechanism, and a support rod. The first driving unit can drive the driving rod to move, and sequentially drive the linkage mechanism and the support rod, so that the main body of the transformable toy car is lifted from a plane at which the transformable toy car is located to pivotally rotate upwards. Besides, a door of the transformable toy car may be driven by the linkage mechanism to be unfolded towards a direction away from the main body. The tail of the transformable toy car can pivotally rotate in relative to the support rod to become a weapon accessory of the robot. In a plurality of embodiments of the present invention, the main body of the transformable toy car is driven by the first driving unit to pivotally rotate in relative to a head, so that the main body is lifted to become the body portion of the robot, and the head becomes the foot pedestal portion of the robot. Therefore, in design of the transformation mechanism assembly in the plurality of embodiments of the present invention, the main body and the tail of the transformable toy car may be turned over in relative to the head to form a body and the top of the robot.

In order to make the aforementioned and other objectives and advantages of the present invention comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
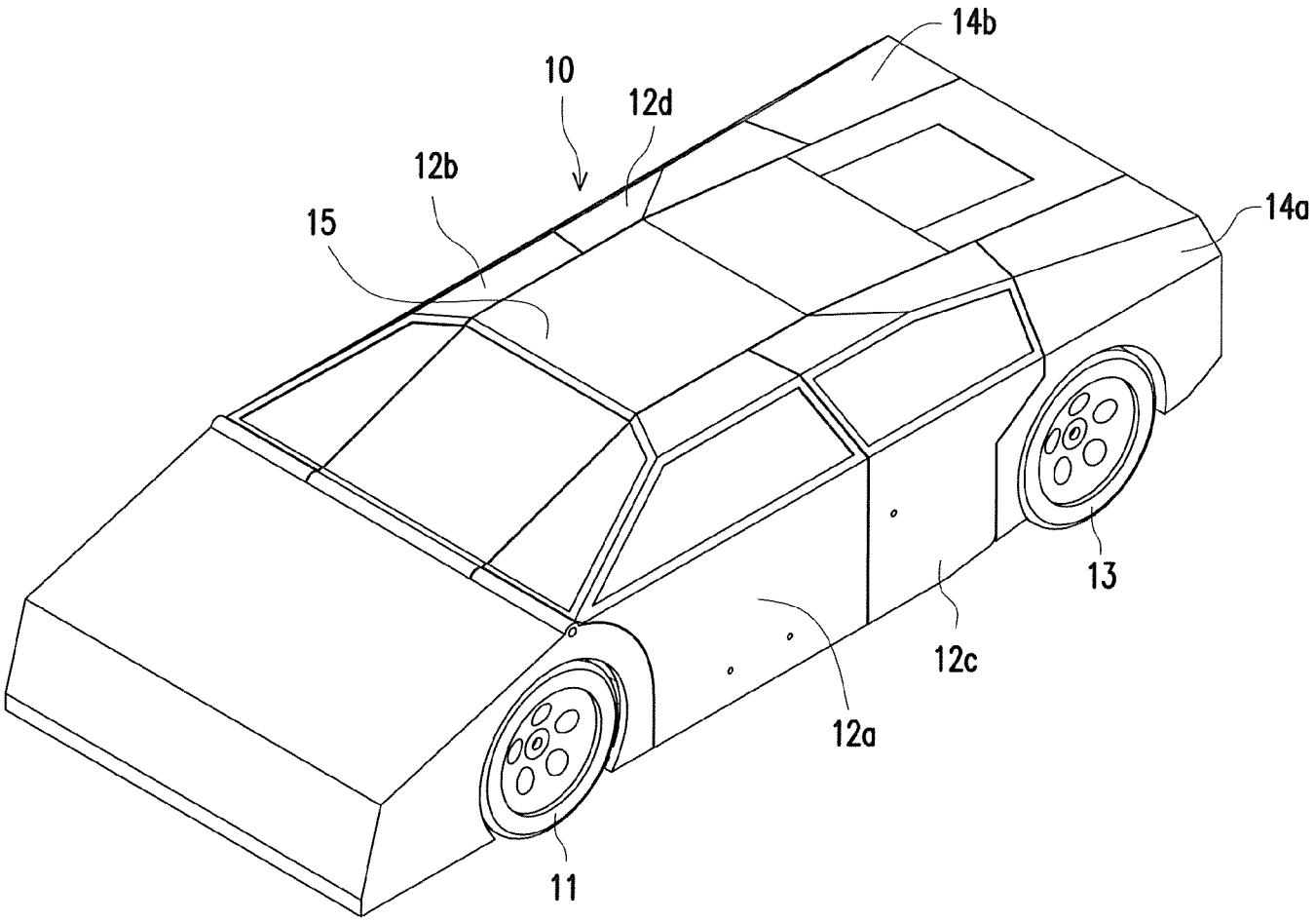
FIG. 1 is a schematic diagram of a transformable toy car according to an embodiment of the present invention.
Figure 2:
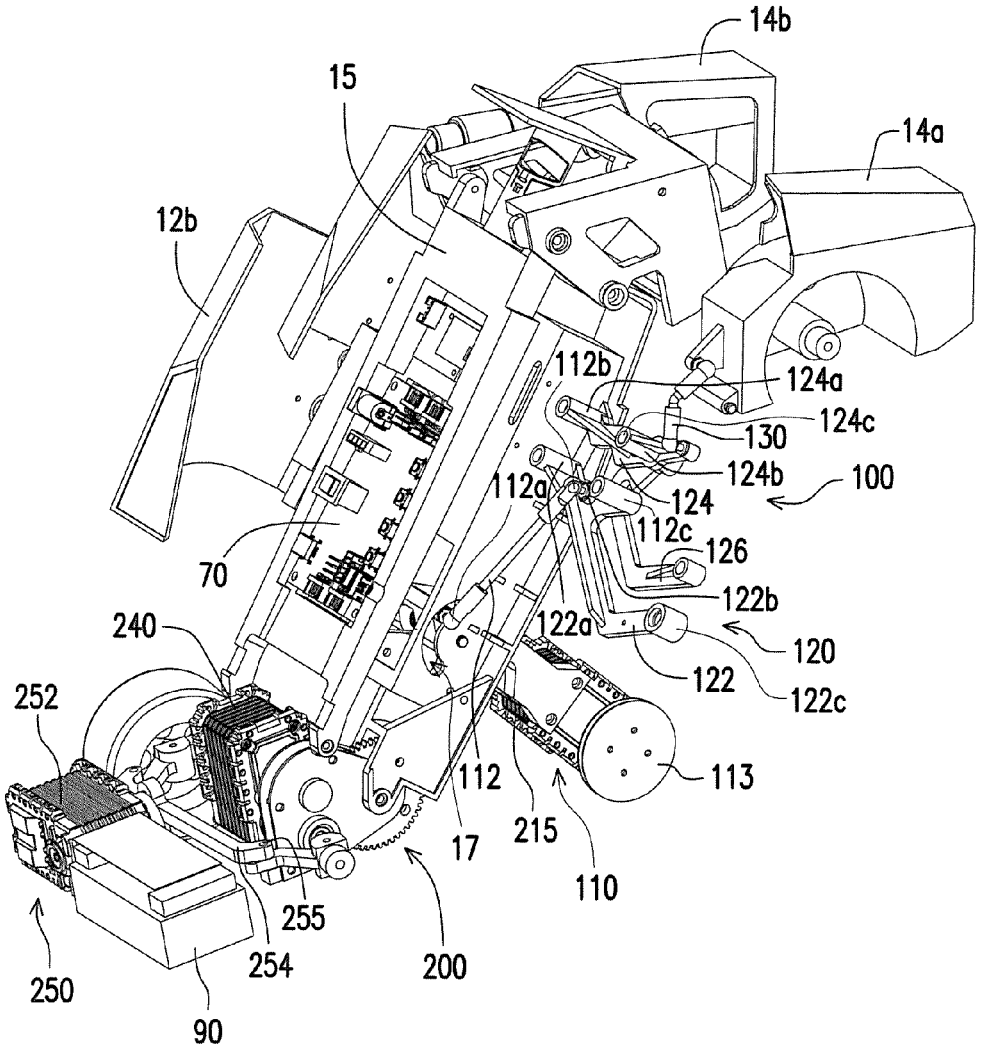
FIG. 2 is a schematic diagram of a transformation mechanism assembly and a driving module assembly according to an embodiment of the present invention.
Figure 3A:
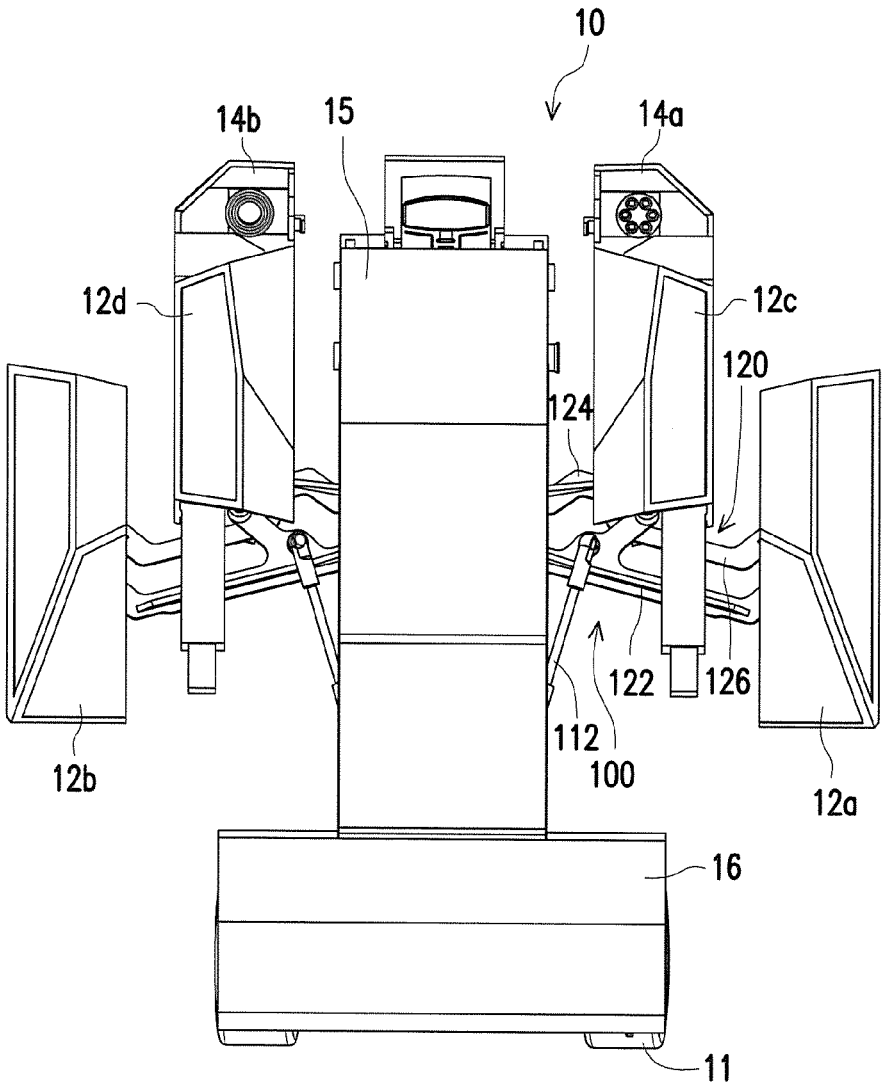
FIG. 3A and FIG. 3B are schematic diagrams of aspects of the transformation mechanism assembly and the driving module assembly according to FIG. 2.
Figure 3B:
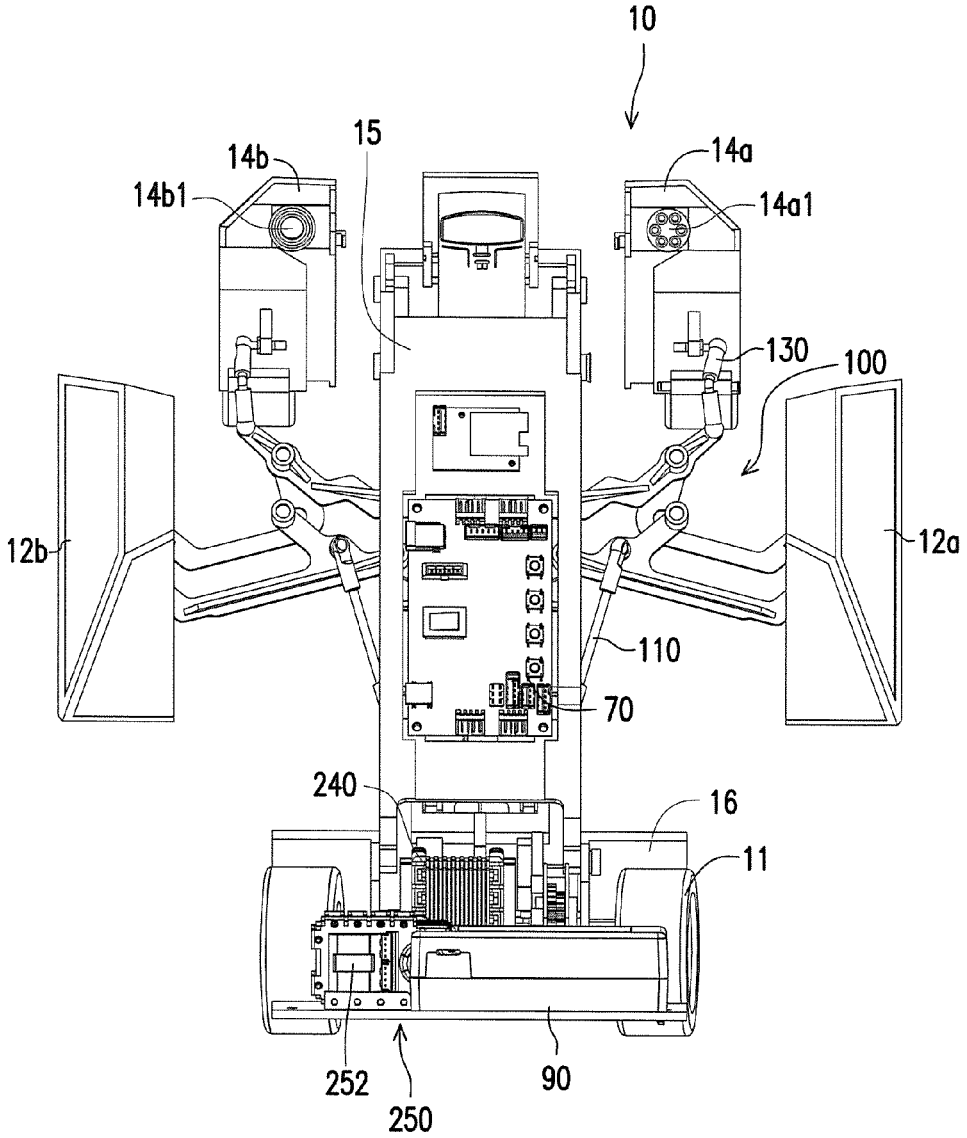

FIG. 1 is a schematic diagram of a transformable toy car according to an embodiment of the present invention. FIG. 2 is a schematic diagram of a transformation mechanism assembly and a driving module assembly according to an embodiment of the present invention. FIG. 3A and FIG. 3B are schematic diagrams of aspects of the transformation mechanism assembly and the driving module assembly according to FIG. 2. Referring to FIG. 1 to FIG. 3B, in this embodiment, a transformable toy car 10 in FIG. 1 can be transformed, after being driven by a transformation mechanism assembly 100 and driven by a driving module assembly 200, into a robot shown in FIG. 3A and FIG. 3B. As shown in FIG. 1, the transformable toy car 10 includes a main body 15, a left front door 12*a*, a right front door 12*b*, a rear left door 12*c*, a rear right door 12*d*, and a left tail 14*a* and a right tail 14*b* that are separable from each other during transformation. Besides, the transformable toy car 10 further includes front wheels 11 at two sides and rear wheels 13 at the two sides.

As shown in FIG. 2, FIG. 3A, and FIG. 3B, in this embodiment, the transformation mechanism assembly 100 can drive the transformable toy car 10 to be transformed into the robot. The transformation mechanism assembly 100 includes a first driving unit 110, a driving rod 112, a linkage mechanism 120, and a support rod 130. The first driving unit 110 is pivotally connected to the main body 15, so as to drive the main body 15 to pivotally rotate in relative to a head 16. Besides, the first driving unit 110 includes a driving roller 113, so as to drive the first driving unit 110 and the transformable toy car 10 to move back and forth. Further, as shown in FIG. 2, the main body 15 includes a limit hole 17, and the driving rod 112 is pivotally connected to the first driving unit 110 via the limit hole 17. When the first driving unit 110 pivotally rotates in relative to the main body 15, the first driving unit 110 drives the driving rod 112 to move along a limit hole towards directions of the left tail and the right tail 14*a*, 14*b*.

In this embodiment, the left tail 14*a* and the right tail 14*b* may further pivotally rotate in relative to the support rod 130, so that the left tail 14*a* and the right tail 14*b* form weapon accessories 14*a*1, 14*b*1 of the robot shown in FIG. 3. Besides, the transformable toy car 10 includes a circuit board 70, which is disposed in the main body 15, so as to enable various control elements and a connection port that is used for electrically connecting an external device to be disposed thereon. Further, the transformable toy car 10 may attach a power supply assembly 90, such as a lithium battery pack, into the head 16, and the power supply assembly 90 may be electrically connected to the circuit board 70.

The driving rod 112 includes a first end 112*a* and a second end 112*b* opposite to each other, and the driving rod 112 is pivotally connected to the first driving unit 110 via the first end 112*a*. Besides, the linkage mechanism 120 is pivotally connected to the main body 15, and the linkage mechanism 120 includes a first linkage 122, a second linkage 124, and a third linkage 126. The first linkage 122 includes a first pivoting end 122*a*, a second pivoting end 122*b*, and a first connecting end 122*c*. The first linkage 122 is pivotally connected to the main body 15 via the first pivoting end 122*a*, and the second pivoting end 122*b* is pivotally connected to the second end 112*b* of the driving rod 112. Further, the left front door 12*a* and the right front door 12*b* are respectively connected to the first linkage 122 via the first connecting end 122*c*.

As shown in FIG. 2, the second linkage 124 includes a third pivoting end 124*a*, a fourth pivoting end 124*b*, and a second connecting end 124*c*, and the second linkage 124 is pivotally connected to the main body 15 via the third pivoting end 124*a*. Besides, the third linkage 126 is pivotally connected to the second linkage 124, so that the left front door 12*a* and the right front door 12*b* are respectively pivotally connected to the second linkage 124 via the third linkage 126. In other words, the left front door 12*a* and the right front door 12*b* are synchronously pivotally connected to the main body 15 via the first linkage 122, the second linkage 124, and the third linkage 126, so that the left front door 12*a* and the right front door 12*b* can pivotally rotate in relative to the main body 15 and therefore are unfolded. Further, the rear left door 12*c* and the rear right door 12*d* are respectively connected to the second connecting ends 124*c* of the second linkages 124 at a left side and a right side of the main body 15.

The support rod 130 is pivotally connected to the fourth pivoting end 124*b* of the second linkage 124. Besides, the left tail 14*a* and the right tail 14*b* are respectively pivotally connected to the support rods 130 at the left side and the right side of the main body 15. As described above, the left tail 14*a* and the right tail 14*b* may further pivotally rotate in relative to the support rods 130 respectively, and therefore form the weapon accessories 14*a*1, 14*b*1 of the robot 10 shown in FIG. 3B. The first driving units 110 may push the driving rod 112 along the limit hole 17 towards the directions of the left tail 14*a* and the right tail 14*b*. Subsequently, the driving rod 112 separately drives the first linkage 122 to pivotally rotate in relative to the main body 15, and the first linkages 122 at the left side and the right side of the main body 15 can respectively drive the left front door 12*a* and the right front door 12*b* to move towards directions away from the main body 15, so that the left front door 12*a* and the right front door 12*b* pivotally rotate in relative to the main body 15 and therefore are unfolded.

The same as above, the left front door 12*a* and the right front door 12*b* that are pushed by the first linkages 122 are driven by the third linkages 126 and the second linkages 124 to pivotally rotate in relative to the main body 15. Besides, the support rod 130, the left tail 14*a*, and the right tail 14*b* are pushed by the second linkage 124, so as to be unfolded towards directions away from the main body 15.

In this embodiment, the front wheels 11 at the two sides and the driving roller 113 are arranged as an inverted triangle. When the transformable toy car 10 is transformed into the robot 10 shown in FIG. 3A and FIG. 3B, the head of the transformable toy car 10 is transformed into a foot pedestal of the robot 10, and the main body 15 is transformed into a body portion of the robot 10. Besides, the front wheels 11 at the two sides and the driving roller 113 together can provide, at a plane at which the transformable toy car 10 is located, stable and balanced support for the main body 15, the left tail 14*a*, the right tail 14*b*, and the front and rear doors 12*a*, 12*b*, 12*c*, 12*d* that are unfolded towards the two sides of the main body 15.

Figure 4:
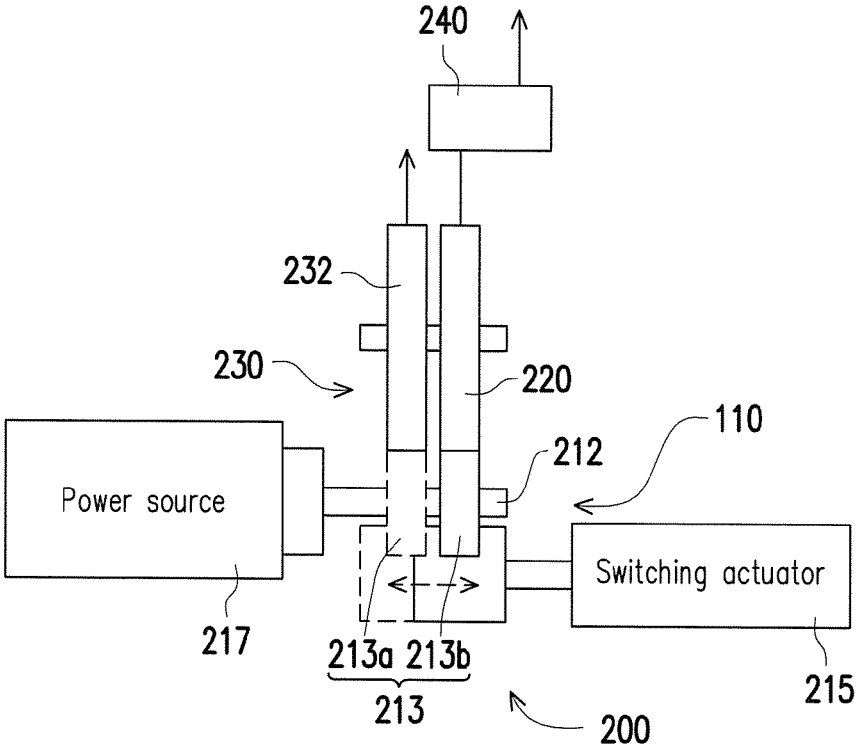
FIG. 4 is a schematic diagram of a driving module assembly according to an embodiment of the present invention.
Figure 5:
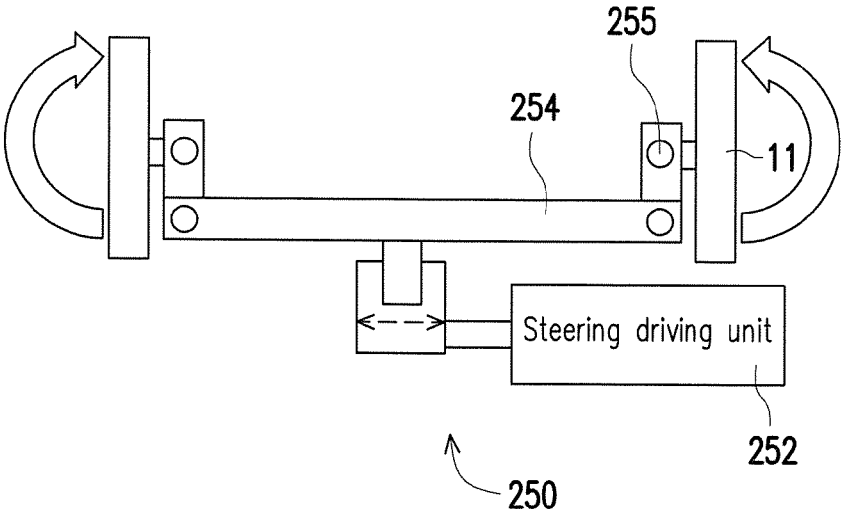
FIG. 5 is a schematic diagram of some components of the driving module assembly according to FIG. 4.

FIG. 4 is a schematic diagram of a driving module assembly according to an embodiment of the present invention. FIG. 5 is a schematic diagram of some components of the driving module assembly according to FIG. 4. In this embodiment, the driving module assembly 200 may be adapted to drive the aforementioned transformation mechanism assembly 100. The driving module assembly 200 includes the aforementioned first driving unit 110, a second driving unit 240, and a steering module 250. In this embodiment, the second driving unit 240 is coupled to the main body 15. For example, the second driving unit 240 is coupled between the first driving unit 110 and the main body 15.

Specifically, for example, the second driving unit 240 is a driving gearbox, which can be adapted to adjust a torque generated when the main body 15 pivotally rotates in relative to the head 16, thereby further adjusting a speed of lifting the main body 15 in relative to the head 16. In this embodiment, the first driving unit 110 further includes a switching actuator 215, which is coupled to the first driving unit 110 and adapted to switch between a driving mode that the first driving unit 110 drives the second driving unit 240 along an arrow direction in FIG. 4 and a driving mode that the first driving unit 110 drives the driving roller 113 along an arrow direction in FIG. 4.

In the driving mode that the first driving unit 110 drives the driving roller 113, the first driving unit 110 may drive the driving roller 113 to rotate along a clockwise direction or a counterclockwise direction, so as to drive the transformable toy car 10 to move forward or backward. Therefore, when the transformable toy car 10 is in a driving mode that the transformable toy car 10 moves forward or backward, the switching actuator 215 can switch to the driving mode that the first driving unit 110 drives the driving roller 113. At the same time, the first driving unit 110 stops driving the second driving unit 240.

When the first driving unit 110 is utilized to drive the main body 15 to pivotally rotate in relative to the head 16, the first driving unit 110 can switch, by using the switching actuator 215, to the driving mode of outputting a drive force to the second driving unit 240. As described above, in this embodiment, the second driving unit 240 is a driving gearbox, which can adjust an output torque of the first driving unit 110, thereby further adjusting a speed of lifting the main body 15 in relative to the head 16.

As shown in FIG. 4, the first driving unit 110 of this embodiment further includes a power source 217, for example, a drive motor. Besides, the first driving unit 110 further includes a power output gear set 213, including a first power gear 213*a* and a second power gear 213*b*. As shown in FIG. 4, the first power gear 213*a* and the second power gear 213*b* may be pivotally connected to a power source 217 via a pivot 212.

In this embodiment, the driving module assembly 200 may include a transformation transmission gear set 220 and a moving transmission gear set 230. In this embodiment, the transformation transmission gear set 220 is coupled between the first power gear 213*a* and the second driving unit 240. The first power gear 213*a* can drive the transformation transmission gear set 220 to pivotally rotate. Besides, the second driving unit 240 may be used to adjust a drive torque of the transformation transmission gear set 220, so as to adjust a speed of lifting the main body 15 in relative to the head 16 and a moving speed of the integral transformation mechanism assembly 100.

The moving transmission gear set 230 includes a plurality of transmission gears 232 coupled between the second power gear 213*b* and a roller shaft of the driving roller 113. In this embodiment, the transmission gears 232 drive the driving roller 113 to pivotally rotate along the clockwise direction or the counterclockwise direction, thereby further driving the transformable toy car 10 to move forward or backward.

In another embodiment that is not shown of the present invention, the second driving unit 240 may be a drive motor, and the second driving unit 240 can be independently used to drive the main body 15 to pivotally rotate in relative to the head 16. That is, the first driving unit 110 can be independently used to drive the driving roller 113, without being used to drive the main body 15 to pivotally rotate in relative to the head 16 and therefore to lift the main body 15 at same time. Therefore, in this embodiment, the first driving unit 110 does not have to additionally include the switching actuator 215 for switching between different driving modes, and the movements of the driving roller 113 and the main body 15 are respectively driven by independent drive motors.

The driving module assembly 200 of this embodiment may further include a steering module 250, which is disposed between the front wheels 11 at the two sides of the transformable toy car 10. Besides, the steering module 250 includes a steering driving unit 252, a steering linkage 254, and two steering shafts 255. The steering linkage 254 is coupled to the steering driving unit 252. The steering shafts 255 are respectively disposed at two ends of the steering linkage 254. Besides, the front wheels 11 at the two sides are respectively pivotally connected to the steering linkage 254 via the steering shafts 255.

In this embodiment, the steering driving unit 252 is a steering drive motor or a steering actuator, for example. The steering driving unit 252 can control a deflection direction or a deflection amplitude of the front wheels 11 at the two sides. As shown in FIG. 5, the steering driving unit 252 can drive, along a thin arrow direction in FIG. 5, the front wheels 11 at the two sides of the main body 15 to pivotally rotate in relative to the steering shafts, so as to enable the front wheels 11 at the two sides to be deflected towards left or right along a thick arrow direction.

In view of the foregoing, in a plurality of embodiments of the present invention, a transformable toy car may be transformed into a robot after being driven by a transformation mechanism assembly and a driving module assembly. A first driving unit of the driving module assembly may be adapted to drive a mechanism of the transformable toy car to move, so that a main body of the transformable toy car is lifted to become a body portion of the robot. Besides, the first driving unit may be also adapted to drive a driving roller to pivotally rotate along a clockwise direction or a counterclockwise direction, so as to drive the transformable toy car to move forward or backward.

In some embodiments of the present invention, by means of configuration of a switching actuator, the first driving unit may also be adapted to drive the transformable toy car to be transformed or drive the transformable toy car to move forward or backward. Besides, the first driving unit may be coupled to the second driving unit, for example, a driving gearbox, so as to adjust an output torque of the first driving unit, thereby further adjusting a speed of pivotal rotation of the main body of the transformable toy in relative to a head and a speed of lifting the main body. Further, in this embodiment, the front wheels at two sides and the driving roller of the transformable toy car are arranged as an inverted triangle. Therefore, when the main body and the tail are lifted in relative to the head and therefore the transformable toy car is transformed into the robot, the front wheels at the two sides and the driving roller provide, at a plane at which the transformable toy car is located, stable and balanced support for the entire robot from the head and the bottom of the main body, thereby enabling the robot to stand at the plane.

In some other embodiments of the present invention, the second driving unit may be a drive motor, which can independently drive the main body of the transformable toy car to pivotally rotate in relative to the head, so that the first driving unit does not need to further include a switching actuator for switching between power outputs of the first driving unit to the transformation mechanism assembly and the driving roller. That is, in some other embodiments of the present invention, the transformation mechanism assembly and the driving roller for controlling the transformable toy car to move forward or backward may be coupled to different power sources respectively.

In a plurality of embodiments of the present invention, the driving module assembly may further include a steering module, which is disposed between front wheels at two sides of the transformable toy car. The steering module may be adapted to control a steering amplitude and direction of the front wheels of the transformable toy car, thereby driving the transformable toy car to move towards different directions or angles. In a plurality of embodiments of the present invention, by means of configuration of the steering module, the transformable toy car of the present invention is not limited to a conventional movement manner that a rotation speed difference between two rear wheels is used to control a deflection direction of the toy car, and a deflection direction and a deflection amplitude of the transformable toy car can be controlled in a more effective and accurate manner.

Although the present invention is described above by means of embodiments, the above description is not intended to limit the present invention. A person of ordinary skill in the art can make variations and modifications without departing from the spirit and scope of the present invention. Therefore, the protection scope of the present invention is as defined in the appended claims.

What is claimed is:

1. A transformation mechanism assembly, adapted to a transformable toy car, the transformable toy car comprising a head, a main body, a left front door, a right front door, a rear left door, a rear right door, and a left tail and a right tail separable from each other, two sides of the main body being respectively disposed with the transformation mechanism assembly corresponding to the left front door, the rear left door, the right front door, and the rear right door, the main body being adapted to pivotally rotate in relative to the head, and the transformation mechanism assembly comprising:

a first driving unit, pivotally connected to the main body, and the first driving unit comprising a driving roller;

a driving rod, comprising a first end and a second end opposite to each other, and the driving rod being pivotally connected to the first driving unit via the first end;

a linkage mechanism, pivotally connected to the main body, and the linkage mechanism comprising:

a first linkage, comprising a first pivoting end, a second pivoting end, and a first connecting end, the first pivoting end being pivotally connected to the main body, the second pivoting end being pivotally connected to the second end of the driving rod, and the left front door and the right front door being respectively connected to the first linkage via the first connecting end;

a second linkage, comprising a third pivoting end and a fourth pivoting end, and the second linkage being pivotally connected to the main body via the third pivoting end; and a third linkage, pivotally connected to the second linkage, and the left front door and the right front door being respectively pivotally connected to the second linkage via the third linkage; and a support rod, pivotally connected to the fourth pivoting end of the second linkage, the left tail and the right tail being respectively pivotally connected to the support rod, the first driving unit being adapted to push the driving rod towards directions of the left tail and the right tail, the driving rod driving the first linkage to pivotally rotate in relative to the main body, the left front door and the right front door being respectively pushed by the first linkage to move towards directions away from the main body, and respectively pivotally rotating in relative to the main body by means of the second linkage and the third linkage, and the support rod, the left tail, and the right tail being respectively pushed by the second linkage to move towards directions away from the main body.

2. The transformation mechanism assembly according to claim 1, wherein the second linkage comprises a second connecting end, and the rear left door and the rear right door are respectively connected to the second connecting end.

3. The transformation mechanism assembly according to claim 1, wherein the transformable toy car comprises a circuit board disposed in the main body.

4. A driving module assembly, comprising the first driving unit according to claim 1, and adapted to drive the transformation mechanism assembly and the transformable toy car, the transformable toy car further comprising front wheels at two sides, and the driving module assembly comprising:

a second driving unit, coupled to the main body, and adapted to drive the main body to pivotally rotate in relative to the head; and a steering module, disposed between the front wheels at the two sides, the steering module comprising:

a steering driving unit;

a steering linkage, coupled to the steering driving unit; and two steering shafts, respectively disposed at two ends of the steering linkage, wherein the front wheels at the two sides are respectively pivotally connected to the steering linkage via the two steering shafts.

5. The driving module assembly according to claim 4, wherein the second driving unit is a driving gearbox, and the second driving unit is coupled between the first driving unit and the main body.

6. The driving module assembly according to claim 5, wherein the first driving unit further comprises a switching actuator for switching between driving outputs of the first driving unit to the driving roller and the driving gearbox.

7. The driving module assembly according to claim 4, wherein the second driving unit is a drive motor.

8. The driving module assembly according to claim 4, wherein the first driving unit further comprises a power source for providing a driving force for the first driving unit.

9. The driving module assembly according to claim 4, wherein the steering driving unit is a steering drive motor or a steering actuator.

10. A transformable toy car, adapted to be transformed, after being driven, into a robot, and the transformable toy car comprising:

a head;

a main body, pivotally connected to the head;

a pair of front wheels, respectively pivotally connected to two sides of the head;

a steering module, disposed between the pair of front wheels; and a driving roller, pivotally connected to the main body, the pair of front wheels and the driving roller being arranged as an inverted triangle, and the pair of front wheels and the driving roller together supporting the robot when the transformable toy car being transformed into the robot.

11. The transformable toy car according to claim 10, wherein the steering module is disposed between the pair of front wheels, and the steering module comprises:

a steering driving unit;

a steering linkage, coupled to the steering driving unit; and two steering shafts, respectively disposed at two ends of the steering linkage, wherein the pair of front wheels are respectively pivotally connected to the steering linkage via the two steering shafts.

12. A robot, adapted to be obtained by transforming a transformable toy car, the transformable toy car comprising a head, a main body, a pair of front wheels, and a driving roller, the main body being pivotally connected to the head, the pair of front wheels being respectively pivotally connected to two sides of the head, the driving roller being pivotally connected to the main body, the pair of front wheels and the driving roller being arranged as an inverted triangle, and the robot comprising:

a foot pedestal portion, wherein the head is transformed into the foot pedestal portion; and a body portion, pivotally connected to the foot pedestal portion, wherein the main body of the transformable toy car pivotally rotates in relative to the head and therefore is lifted and transformed into the body portion, and the pair of front wheels and the driving roller together support the robot to stand at a plane.

* * * * *